United States Patent [19]

Dobosi

[11] 4,263,690

[45] Apr. 28, 1981

[54] PAINT ROLLER TOOL WITH HAND GRIP

[76] Inventor: Laszlo J. Dobosi, 4317 Markwood La., Fairfax, Va. 22030

[21] Appl. No.: 73,210

[22] Filed: Sep. 7, 1979

[51] Int. Cl.[3] ..... B05C 17/02; A46B 5/02

[52] U.S. Cl. ..... 15/145; 15/230.11; D4/38.1

[58] Field of Search ..... 15/23, 24, 28, 29, 27, 15/143 R, 143 A, 143 B, 144 R, 144 A, 144 B, 145, 176, 230.11, 236 R, 244 R; 239/526, 527; D4/10-12, 29, 31, 38.1

[56] References Cited

U.S. PATENT DOCUMENTS

| | | | |
|---|---|---|---|
| 3,773,375 | 11/1973 | Nehls | 15/143 B |
| 4,108,189 | 8/1978 | Claiborne et al. | 15/230.11 X |

FOREIGN PATENT DOCUMENTS

| | | | |
|---|---|---|---|
| 1176658 | 11/1958 | France | 15/230.11 |
| 541861 | 4/1956 | Italy | 15/144 R |
| 47-22736 | of 1972 | Japan | 239/526 |

*Primary Examiner*—Edward L. Roberts

*Attorney, Agent, or Firm*—Larson, Taylor and Hinds

[57] ABSTRACT

A paint roller tool is disclosed on which a paint roller is placed for painting walls, ceilings and the like. Attached to the handle of the paint roller tool is a hand grip which forms an angle of between 35° and 65° with the handle. The hand grip slopes away from the paint roller so that the paint roller tool is easily and comfortably held by a user.

7 Claims, 4 Drawing Figures

PAINT ROLLER TOOL WITH HAND GRIP

FIELD OF THE INVENTION

This invention relates generally to apparatus for applying paint and more particularly to a paint roller tool having an angled hand grip.

BACKGROUND OF THE INVENTION

When painting large flat areas such as ceilings and walls, it is a common practice to use a paint roller to apply the paint. While this practice is very effective, the hand of the user often becomes very tired from holding on to the handle portion of a conventional paint roller tool. In addition, the conventional paint roller tool is also burdensome and difficult to use in some confined areas such as in closets and on scaffolds.

In order to permit the use of two hands to hold the paint roller tool, a short extension pole has been screwed into the end of the handle so that both hands can then hold the tool. Similarly, in U.S. Pat. No. 2,281,773 to Kollmann where a heavy paint rolling tool including a paint supply tube and hand operated valving means is disclosed, a laterally extending hand grip is used to provide a second handhold so that both hands can grip the device. A laterally extending hand grip, used on the end of a snow removal device, is also disclosed in U.S. Pat. No. 3,773,375 to Nehls. In U.S. Pat. No. 3,286,297 to MacFarland, a caulking gun device with a lateral handle is disclosed. The caulking gun is used on the end of a floor wax applying roller to supply wax to the roller. On the paint brush device for painting parking lots and such disclosed in U.S. Pat. No. 2,717,404 to Finch, an angled handle is provided at the end of a long rod which is used to push and pull the device.

The prior art, however, fails to provide for a paint roller device which can be easily and comfortably held in one hand and used in confined spaces as well.

SUMMARY OF THE INVENTION

The present invention provides a paint roller tool with an easy and comfortable hand grip. The hand grip of the present invention is rigidly attached to the handle of the tool so that it forms an angle of between 35° to 65°. In this position, the paint roller is comfortably gripped in one hand and it may be easily used in confined areas such as in closets and on scaffolds.

Additional features and advantages of the present invention are apparent from, or will be set forth in, the detailed descriptions of the preferred embodiments found hereinbelow.

DETAILED DESCRIPTION OF PREFERRED EMBODIMENTS

Figure 1:
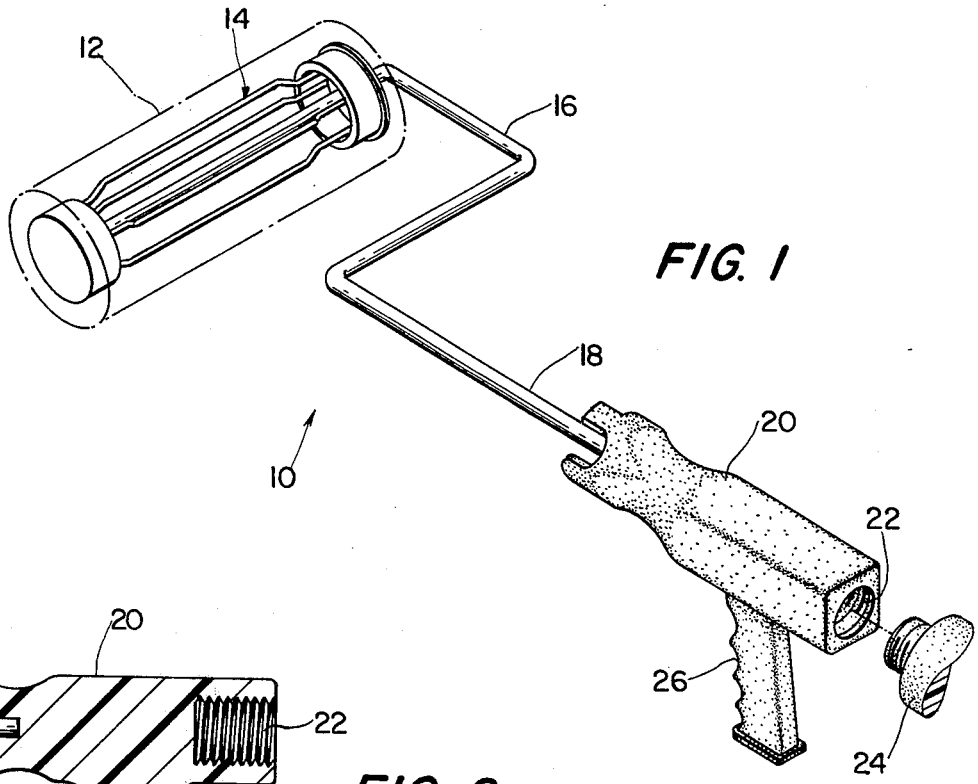
FIG. 1 is a perspective view of a preferred embodiment of the paint roller tool and hand grip of the present invention.
Figure 2:
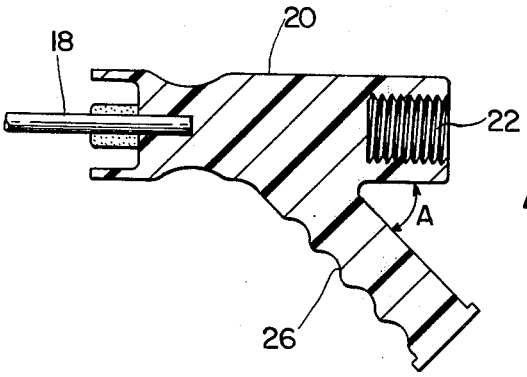
FIG. 2 is a cross-sectional front view of the hand grip and handle portion depicted in FIG. 1.

With reference now to the drawings in which like numerals represent like elements throughout the several views, a presently preferred embodiment of the present invention is depicted in FIG. 1 and comprises a paint roller tool 10 having a detachable paint roller 12 (shown in phantom) mounted on a paint roller receiver 14. Paint roller receiver 14 is rotatably mounted at one end of an elongate rod handle member 16. The other end of rod member 16 is formed into a shank 18 which extends perpendicular to the longitudinal axis of paint roller receiver 14 at a point midway of the ends of paint roller receiver 14. Rod member 16 is substantially coplanar with the axis of rotation of the receiver 14. Extending straight back from shank 18 is a handle 20. The proximal end of handle 20 is rigidly attached to shank 18 while the distal end contains a threaded bore 22 in which a threaded handle extension pole 24 can be detachably received. Rigidly attached to handle 20 is a hand grip 26. As shown in FIG. 2, hand grip 26 is formed integrally with handle 20 and both are made from plastic. Hand grip 26 is positioned so as to slope away from roller receiver 14 and forms an acute angle A with the portion of handle 20 which extends rearwardly of grip 26 in a direction away from shank 18. Preferably, angle A is approximately 45°, although any angle between 35° to 65° is adequate. Hand grip 26 and handle 20 form a plane which is normal with respect to the axis of rotation of roller receiver 14. In order to make the paint roller tool light and easily controllable, the distance from hand grip 26 to paint roller receiver 14 should be between 10 to 14 inches, and preferably about 12 inches.

In operation, paint roller tool 10 functions in the following manner. When painting in a confined area, paint roller tool 10 is easily and comfortably grasped by a single hand on hand grip 26. Hand grip 26 is used to move wetted paint roller 12 along the areas to be painted. It should be noted that paint roller tool 10 is used with hand grip 26 pointing in any direction, although normally hand grip 26 points more or less either downward or upward. Hand grip 26 may also be used in open areas, or if desired, extension pole 24 is inserted into bore 22 and extension pole 24 may be used as a handle.

Figure 3:
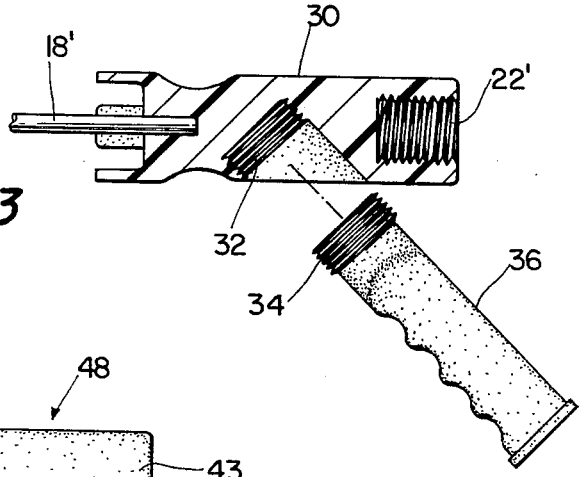
FIG. 3 is a cross-sectional front view of a second embodiment of the hand grip and handle portion of the present invention.

A second embodiment of the present invention is depicted in FIG. 3. In this embodiment, a hand grip 36 is detachably mounted in a handle 30 by means of a threaded bore 32 in handle 30 and a threaded end 34 on hand grip 36. In this way, hand grip 36 can be removed out of the way when extension pole 24 is inserted into threaded bore 22'.

Figure 4:
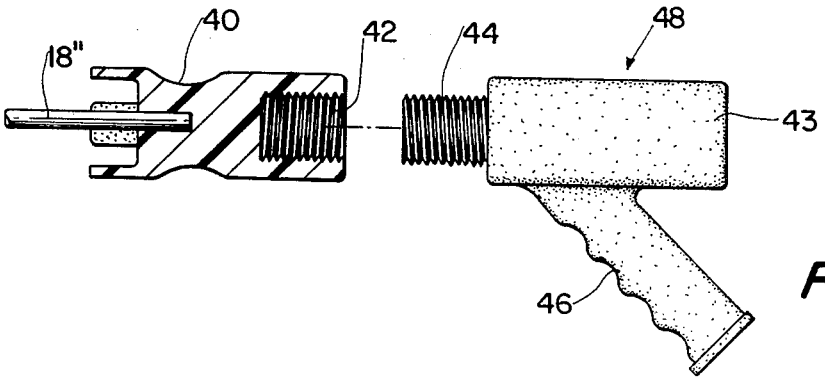
FIG. 4 is a cross-sectional front view of a third embodiment of the hand grip and handle portion of the present invention.

A third embodiment of the present invention is depicted in FIG. 4. In this embodiment, handle 40 has a threaded bore 42 which can receive either extension pole 24 or a threaded hand grip mount 48. Hand grip mount 48 consists of a hand grip 46 rigidly attached at an angle of 45° to a hand grip body 43 having a threaded end 44. With this arrangement, either hand grip mount 48 or extension pole 24 is received into threaded bore 42 depending on the preference of the user.

Although the invention has been described in detail with respect to exemplary embodiments thereof, it will be understood by those of ordinary skill in the art that variations and modifications may be effected within the scope and spirit of the invention.

What is claimed is:

1. A paint roller tool for receiving a paint roller comprising:

an elongate paint roller receiver;

a rod handle member substantially coplanar with the longitudinal axis of said paint roller receiver and rotatably attached at one end to said paint roller receiver, said rod handle member having at the opposite end an offset shank extending perpendicularly to the longitudinal axis of said paint roller receiver;

an elongate handle extending straight back from the shank of said rod handle member and whose proximal end is rigidly attached thereto, the distal end of said handle having a threaded bore for receiving a handle extension pole; and an elongate hand grip constructed and arranged to be grasped by the hand, and having a size such that, when grasped, the operator is able to manipulate the tool for painting a surface, said hand grip being rigidly attached to said handle and extending away from the shank of said rod member, the longitudinal axis of said hand grip forming an angle of between 35° and 65° with the longitudinal axis of said handle so that the plane formed by the longitudinal axes of said hand grip and said handle is normal to the longitudinal axis of said paint roller receiver;

such that in use, the paint roller tool is easily and comfortably held by said hand grip.

2. A paint roller tool as claimed in claim 1, wherein said hand grip forms an angle of 45° with said handle.

3. A paint roller tool as claimed in claim 1 wherein said handle and said grip are integrally formed of plastic material.

4. A paint roller tool as claimed in claim 1, wherein said hand grip is detachably mounted to said handle.

5. A paint roller tool as claimed in claim 4, wherein said hand grip is threadably attached to said handle.

6. A paint roller tool as claimed in claim 5, wherein said hand grip is attached to said handle by means of the threaded bore at the distal end of said handle.

7. A paint roller tool as claimed in claim 1, wherein the distance between said hand grip and said paint roller receiver is approximately 10 to 14 inches.

* * * * *